US005584610A

United States Patent [19]

Simpson et al.

[11] Patent Number: 5,584,610

[45] Date of Patent: Dec. 17, 1996

[54] BULKHEAD

[76] Inventors: Garland E. Simpson, P.O. Box 2055, Nederland, Tex. 77627; William G. Webb, Rte. 4, Box 626, Beaumont, Tex. 77705

[21] Appl. No.: 172,498

[22] Filed: Dec. 23, 1993

[51] Int. Cl.[6] ..... E02D 5/00; E02D 5/04

[52] U.S. Cl. ..... 405/281; 52/300; 405/248; 405/274

[58] Field of Search ..... 405/283, 237, 405/248, 255, 267, 269, 274, 244, 273, 284, 275–281; 52/300, 607

[56] References Cited

U.S. PATENT DOCUMENTS

| | | | |
|---|---|---|---|
| 745,453 | 12/1903 | McBean | 405/274 |
| 1,024,822 | 4/1912 | Bignell | 405/280 |
| 4,110,989 | 9/1978 | Selkirk | 405/248 |
| 4,154,554 | 5/1979 | Hilfiker | 405/273 |
| 4,312,606 | 1/1982 | Sarikelle | 405/273 X |
| 4,707,962 | 11/1987 | McBeen | 405/273 X |
| 4,858,406 | 8/1989 | Lane et al. | 52/300 |
| 5,145,287 | 9/1992 | Hooper et al. | 405/262 |

*Primary Examiner*—Dennis L. Taylor
*Attorney, Agent, or Firm*—John R. Casperson

[57] ABSTRACT

PVC panels for a bulkhead are characterized by an elongated S-shaped cross section and an axial passage extending from top to bottom. The panels are joined by tenon in mortise joints, preferably via a spade shaped tenon. The assembly is capped with a channel to position and strengthen the upper ends of the panels. A stake positioned through the passage and into the earth also secures the panels. The panels are positioned by water flow through the passage during the sinking process. Soil stabilization chemicals can also be introduced through the passage. A nozzle for the lower end of the passage is also disclosed.

8 Claims, 3 Drawing Sheets

FIG. 6
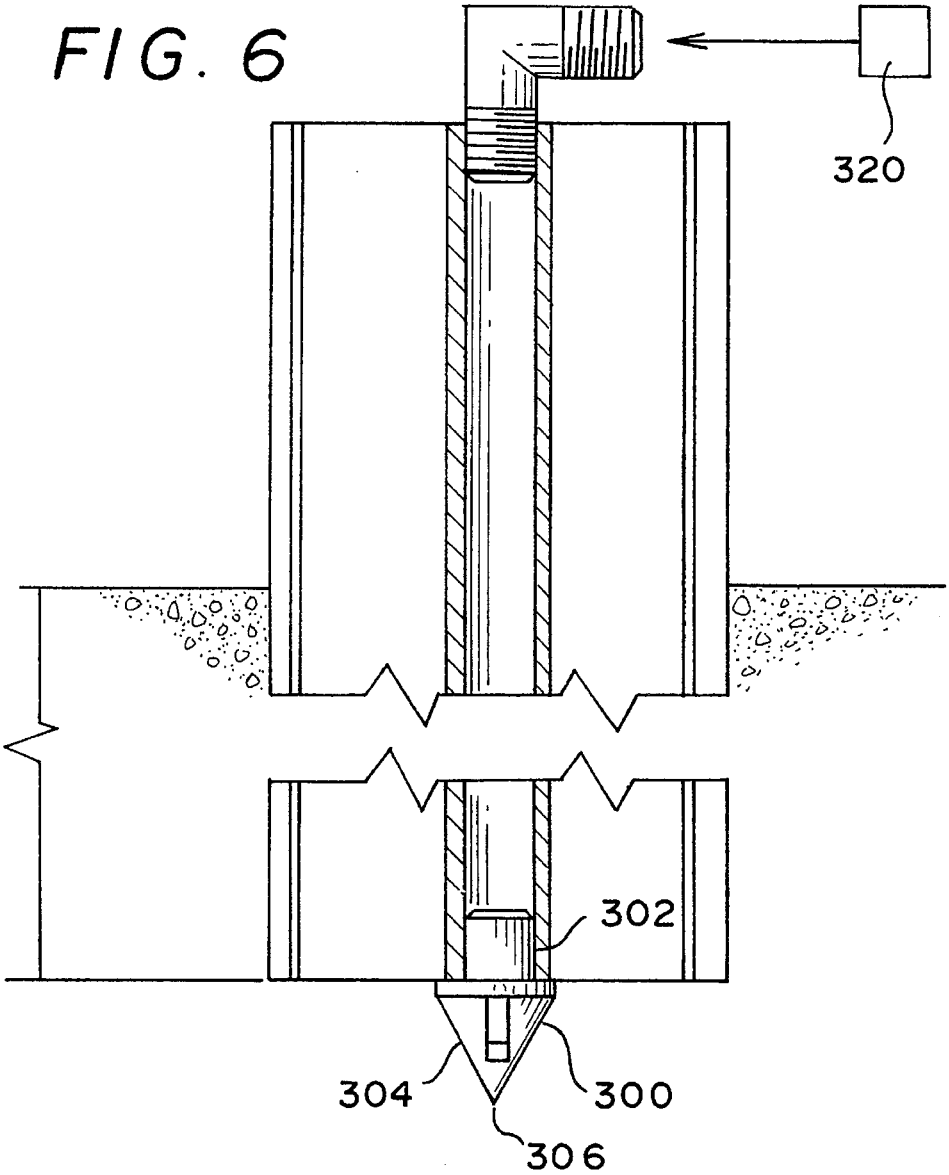
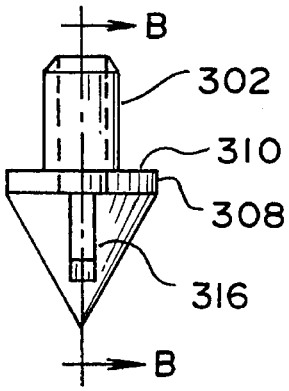
FIG. 7
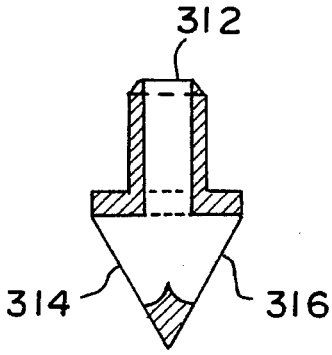
FIG. 8

BULKHEAD

BACKGROUND OF THE INVENTION

The invention relates to new bulkhead components, improvements to bulkheads and to new methods for the placement and stabilization of bulkheads.

Bulkheads are used for soil and fluid retention and for erosion and leakage control. They find use in many applications, including beach stabilization, trench linings, concrete forms, revetment walls, and water and wave barriers.

Bulkheads have traditionally been made from metal or wood. These materials break down over time, especially around salt water. They can be treated to slow their deterioration, but the most effective treatments are not environmentally neutral, containing heavy metals and the like. A bulkhead formed from an environmentally neutral material would be very desirable.

Bulkhead components when formed from concrete, metal or wood can be very heavy, requiring a crew of several people to handle and install. A bulkhead formed from lighter weight components that could be installed by a small crew would be very desirable.

Traditional methods of bulkhead installation have relied on heavy equipment such as pile drivers, cranes and trenchers. A method for bulkhead installation which could be carried out without heavy equipment would be very desirable.

In some environments, a more stable bulkhead could be achieved if it were possible to economically treat or re-treat the earth around the sunken part of the bulkhead with a soil stabilization agent. A method for treating the area around the bulkhead with a soil stabilization agent without the use of special equipment such as probes would be very desirable.

For certain applications, it can be desirable that the bulkhead be water tight. A bulkhead having joints that are easy to seal would be very desirable.

OBJECTS OF THE INVENTION

It is an object of this invention to provide a lightweight bulkhead.

It is a further object of this invention to provide a bulkhead which is formed from environmentally safe materials.

It is another object of this invention to provide a bulkhead that can be installed with a small crew and without the use of heavy equipment.

It is another object of this invention to provide a bulkhead which is designed in a manner to facilitate treatment of the surrounding earth with soil stabilization chemicals.

It is another object of this invention to provide a bulkhead which can easily be made watertight.

SUMMARY OF THE INVENTION

In one embodiment of the invention, there is provided a panel for forming a bulkhead. The panel has a first edge defined by a tenon and a second edge defined by a mortise sized to receive the tenon. The panel has a first end, a second end, and a longitudinal axis extending between the first end and the second end. A first longitudinal bend is present between the longitudinal axis and the tenon. A second longitudinal bend is present between the longitudinal axis and the mortise. The first longitudinal bend and the second longitudinal bend are corotationally directed with respect to the longitudinal axis of panel. The panel configuration is sufficiently strong so that it can be constructed from lightweight, environmentally benign materials such as polyvinylchloride. Where the tenon is generally spade shaped in cross-section, the panel can be made water tight such as with PVC cement and has enough flexibility to be bent as well as to withstand environmental abuse such as pounding by waves. In a preferred embodiment of the invention, the panel is provided with a passage along its longitudinal axis from the first end of the panel to the second end of the panel.

The passage can be used to carry out a method for sinking the panel into the earth. The lower end of the panel is positioned on the surface of the earth. The earth beneath the lower end of the panel is loosened, preferably by a flow of fluid directed downwardly through the passage. The panel is then sunk through the loosened earth.

The passage through the panel also provides a route for introducing a soil stabilization chemical into the earth. A fluid flow containing the desired soil stabilization chemical is injected downwardly through the passage either during or after the positioning of the panel. By practicing this technique, the position of the panel can be stabilized. The panel position can be further stabilized by positioning a stake, such as rebar, through the passage and deep into the underlying earth.

To better distribute fluid flow from the lower end of the passage, a nozzle design is provided in another embodiment of the invention. The nozzle has a first end, a second end, and a longitudinal axis extending between the first end and the second end. A first generally cylindrical portion having a first diameter extends along the longitudinal axis of the nozzle from the first end. A second generally cylindrical portion of the nozzle is positioned along the longitudinal axis of the nozzle. The second generally cylindrical portion of the nozzle has a second diameter greater than the first diameter. A generally annular shoulder connects the first generally cylindrical portion with the second generally cylindrical portion. A conical portion extends along the longitudinal axis of the nozzle. The conical portion connects the second generally cylindrical portion with the second end of the nozzle. The nozzle has a borehole extending along the longitudinal axis from the first end and a pair of opposed generally radially extending passages leading from the borehole and opening onto the surface of the conical portion. By positioning the nozzle at the lower end of the passage extending through the panel and orienting the nozzle so that the opposed passages are directed along the bottom edge of the panel, fluid is delivered along the bottom edge of the panel.

In a still further embodiment of the invention, there is provided a bulkhead. The bulkhead comprises an undulating wall having generally vertically oriented bends, a first side surface, a second side surface, an upper end, and a lower end. A longitudinally elongated cap is positioned on the top of the wall. The cap has a top side and a bottom side with the bottom side forming a straight channel which receives the upper end of the undulating wall. The longitudinally elongated cap is positioned in capping relationship with the undulating wall along the upper end of the undulating wall. The cap strengthens the wall and reliably positions the upper ends of the panel.

BRIEF DESCRIPTION OF THE DRAWINGS

FIG. 6 illustrates a process according to certain aspects of the invention.

FIG. 7 illustrates certain details of a portion of the apparatus shown in FIG. 6.

FIG. 8 is a cross sectional view of the apparatus of FIG. 7 taken along lines B—B.

DETAILED DESCRIPTION OF THE PREFERRED EMBODIMENTS

Figure 1:
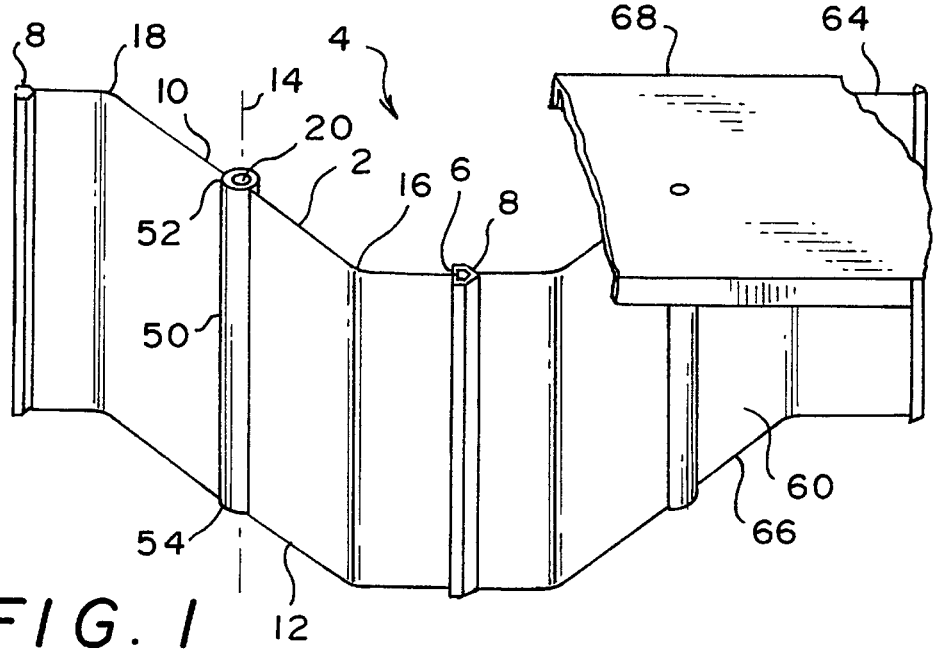
FIG. 1 illustrates schematically a portion of a bulkhead embodying certain features of the invention.

In one embodiment of the invention, there is provided a panel 2 for forming a bulkhead 4. Generally, the bulkhead 4 will be formed by a plurality of panels 2. The panel has a first edge defined by a tenon 6 and a second edge defined by a mortise 8 sized to receive the tenon. The panel has a first end 10, a second end 12, and a longitudinal axis 14 extending between the first end and the second end. A first longitudinal bend 16 is present between the longitudinal axis and the tenon. A second longitudinal bend 18 is present between the longitudinal axis and the mortise. The first longitudinal bend and the second longitudinal bend are corotationally directed with respect to the longitudinal axis of panel. In a preferred embodiment of the invention, the panel 2 is provided with a passage 20 along its longitudinal axis from the first end of the panel to the second end of the panel.

Preferably, the panel has a generally elongated S-shaped cross-section across the longitudinal axis. This aspect of the invention is most clearly shown by FIG. 2. The panel has a first edge portion 22 adjacent to the tenon and a second edge portion 24 adjacent to the mortise. The first edge portion is positioned in a first plane and the second edge portion is positioned in a second plane. The first plane is generally parallel to the second plane. Preferably, both the first plane and the second plane are parallel to the plane of the bulkhead.

Preferably, the panel 2 has a first radially extending portion 26 extending from the longitudinal axis and a first curved portion 28 connecting the first radially extending portion with the first edge portion 22. A second radially extending portion 30 extends from the longitudinal axis in the opposite direction from the first radially extending portion and a second curved portion 32 connects the second radially extending portion with the second edge portion 24. The radially extending portions preferably form a straight wall section which is positioned at an angle in the range of 30 degrees to 60 degrees, preferably in the range of 40 degrees to 50 degrees, from the plane of the bulkhead.

Figure 3:
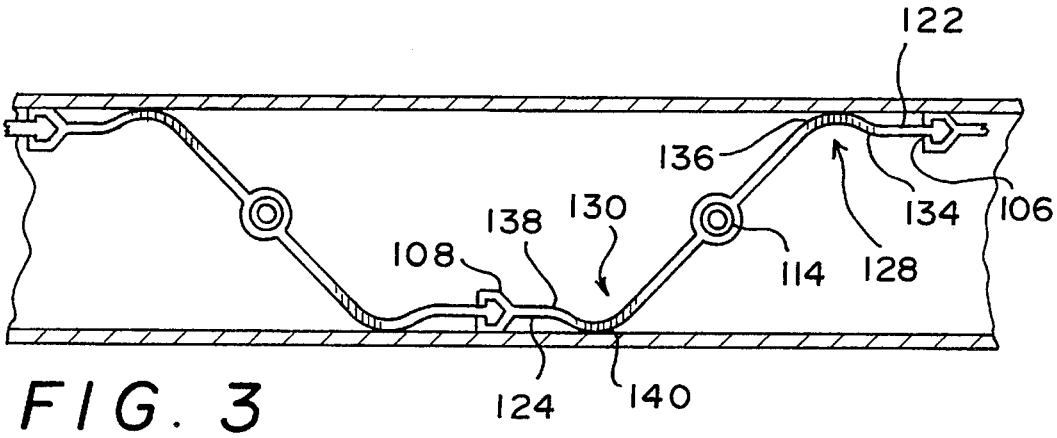
FIG. 3 is a view as in FIG. 2 of another embodiment of the invention which has a different wall configuration.
Figure 4:
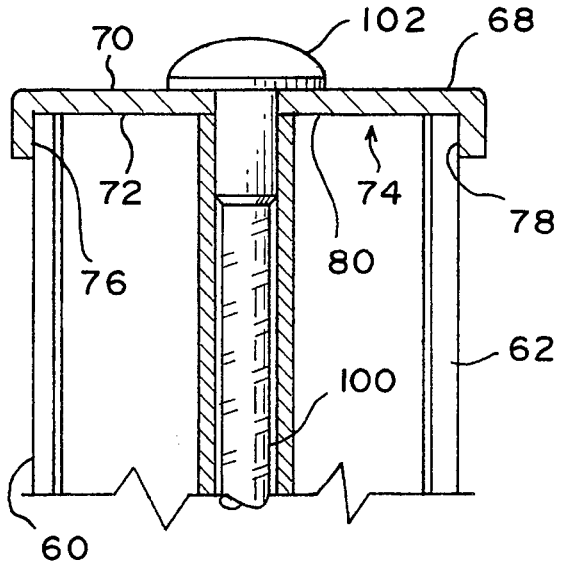
FIG. 4 is a cross sectional view along lines A—A of FIG. 2 with the cap in place.

In the embodiment of the invention shown in FIG. 3, the curved portions of the panel have a pair of bends. The bends can be described as dogleg bends. A first dogleg bend 128 is positioned between the axis 114 and the tenon 106. A second dogleg bend 130 is positioned between the axis and the mortise 108. The first dogleg bend 128 is formed by a pair of bends as in a dog's hind leg with a knee bend 134 and a hock bend 136. The bend 128 is connected to a first edge portion 122 at the knee bend 134. The second dogleg bend 130 has a pair of bends as in a dog's hind leg with a knee bend 138 and hock bend 140. The bend 130 is connected to a second edge portion 124 at the knee bend 138.

Preferably, the mortise 8 is formed by a fork extending from the second edge portion 24 of the panel 2. The fork has two legs which fork outwardly, away from the plane of the second edge portion of the panel, then lead inwardly toward the plane of the second edge portion of the panel to define a slot for receipt of the tenon 6. The tenon 6 is formed by an enlarged bead extending from the first edge portion 22 of the panel 2. The bead comes to a sharp edge which defines the edge of the panel and has a step between the enlarged portion of the bead and the first edge portion 22 of the panel. Most preferably, the tenon is generally spade shaped in the cross section across the longitudinal axis, because it has been found that tenon in mortise joints having this configuration are both bendable and sealable.

The passage 20 is preferably defined by a generally tubularly shaped section 50 of the panel 2 and is preferably configured as a generally cylindrical borehole. The section 20 has a first end 52 and a second end 54 and is positioned along the longitudinal axis 14 to define the passage 20. The first generally radially extending portion 26 of the panel 2 and the second generally radially extending portion 30 of the panel 2 are connected to the generally tubularly shaped section 50.

The bulkhead 4 formed from the panels 2 comprises an undulating wall having generally vertically oriented bends formed by the curved portions of the panels, a first side surface 60, a second side surface 62, an upper end 64, and a lower end 66. A longitudinally elongated cap 68 is positioned on the upper end of the wall. The cap 68 has a top side 70 and a bottom side 72 with the bottom side 72 forming a straight channel which receives the upper end 64 of the undulating wall. The longitudinally elongated cap 68 is positioned in capping relationship with the undulating wall along the upper end of the undulating wall. The cap strengthens the wall and reliably positions the upper ends 10 of the panels 2.

Preferably, the channel 74 is defined by a first sidewall surface 76 facing the first side surface 60 of the undulating wall, a second sidewall surface 78 facing the second side surface 62 of the undulating wall, and an upper endwall 80 facing the upper end 64 of the undulating wall.

Figure 5:
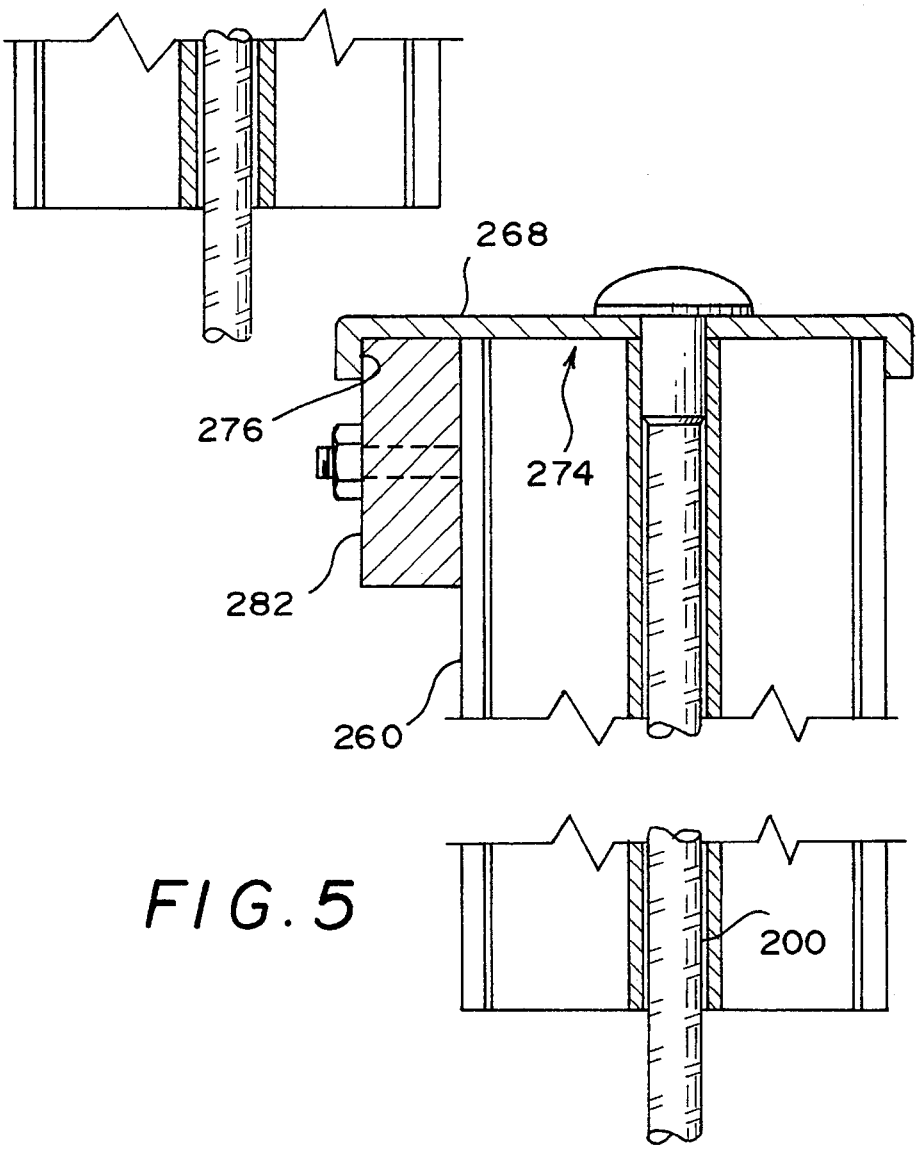
FIG. 5 is a view of another embodiment of the invention from the same perspective as FIG. 4.

In the embodiment of the invention shown in FIG. 5, a longitudinally elongated stiffener 282 having a longitudinal axis normal to the plane of the drawing is positioned alongside a longitudinally elongated cap 268 between a first side surface 260 of the undulating wall and a first sidewall surface 276 of a channel 274. Preferably, the stiffener is straight and is tightly received between the first side surface of the undulating wall and the first sidewall surface of the channel. Generally, the longitudinally elongated stiffener is rectangular in cross section across the longitudinal axis of the stiffener and is preferably formed from plastic, such as recycled plastic. When present, it can be attached to the wall by bolts. A waler (not shown) can also be employed in the invention if desired, running along the front side of the wall and tied to a dead man foundation in the fill behind the wall.

In one embodiment of the invention, pairs of panels form the repeating units in the bulkhead. Each panel is formed by a first panel and a second panel. The individual panels can be as previously described. The panels in a pair are positioned in a head to heel relationship that the first end of the first panel is positioned next to the second end of the second panel to form each pair of panels. The curved portions of the panels are radiused so that the pair of panels are generally U-shaped in cross-section across the longitudinal axis. This gives the pair of panels a flattened U-shaped configuration (see FIG. 2) in cross section which is very stable and strong.

Figure 2:
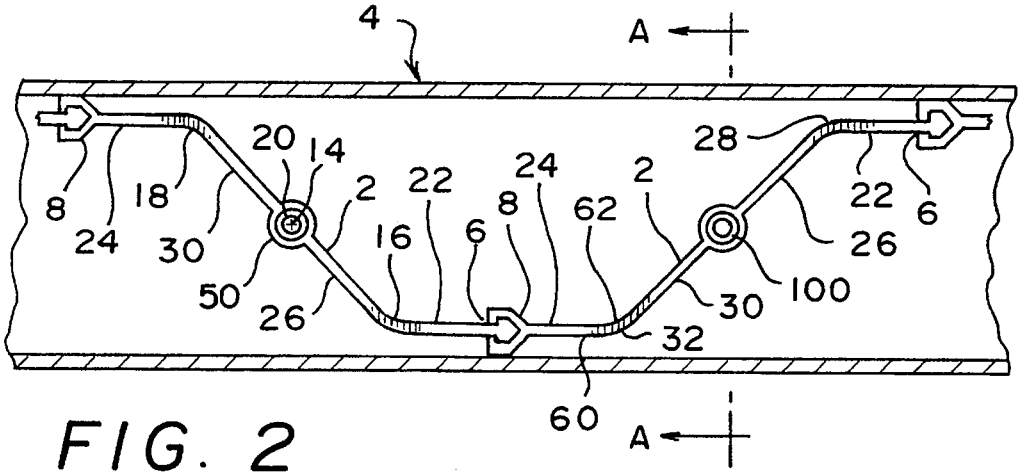
FIG. 2 illustrates a top plan view of the wall of FIG. 1 with the top of the cap removed to show the panel configuration underneath.

In the embodiment of the invention shown in FIG. 2, the panels are positioned by contact between the mortise of each panel and the second sidewall surface of the channel. In the embodiment of the invention shown in FIG. 3 the curved portion of each panel is contacted by the second sidewall surface of the channel. In this embodiment, the contact is between the hock bend of the curved portion of the panel and the sidewall of the channel. The mortise preferably also contacts the sidewall of the channel for extra support. Thus, in the embodiment shown in FIG. 3, each panel contacts the cap at three locations, at both hock bends and the mortise.

In one embodiment of the invention, each panel has a borehole positioned along the longitudinal axis which can be as previously described. A stake 100 is positioned in each borehole securing each panel to the earth. Rebar as used for concrete reinforcement can be used as the stake 100. Preferably, the borehole is defined by the tubularly shaped section. The first end of the generally tubularly shaped section is positioned adjacent to the longitudinally elongated cap 68. A pin 102 extends through the longitudinally elongated cap and is closely received by the first end of the borehole. A pin 102 secures the longitudinally elongated cap to each panel.

Preferably, during the positioning of the panel, end closure 300 is positioned on the second end of the generally tubularly shaped section. The end closure 300 has a generally cylindrically shaped portion 302 closely received by the borehole and a conically shaped portion 304 having a big end and a little end extending away from the borehole and coming to a point 306. The big end of the conically shaped portion is positioned in covering relationship with the second end of the generally tubularly shaped section. The end closure facilitates driving the panel into the ground. It is displaced when the rebar, if used, is driven into the earth to secure the panel.

More preferably, the end closure forms a nozzle having a first end, a second end, and a longitudinal axis extending between the first end and the second end. The first generally cylindrical portion 302 has a first diameter extending along the longitudinal axis from the first end. A second generally cylindrical portion 308 is positioned adjacent to the first generally cylindrical portion 302. The second generally cylindrical portion has a second diameter greater than the first diameter and is connected to the first generally cylindrical portion by a generally annular shoulder 310. The conical portion 304 extends along the longitudinal axis and connects the second generally cylindrical portion 308 with the second end 306 of the nozzle. The nozzle has a borehole 312 extending along the longitudinal axis from the first end and a pair of opposed generally radially extending opposed passages 314 and 316 leading from the borehole 312 and opening onto the surface of the conical portion 304.

To position the panel, the mortise and tenon are registered and the lower end of the panel is positioned on the surface of the earth. A fluid flow, such as from source 320, is directed through the passage and into the earth beneath the lower end of the panel. This loosens the earth, facilitating sinking the panel into the earth. Generally, the fluid will comprise water. Preferably, the fluid is directed to flow along the lower end of the panel from the lower end of the passage. The nozzle previously described is well suited to carry this out.

In some instances, it can be desirable to introduce a soil stabilization chemical into the earth to stabilize the positioning of a panel. The fluid is then caused to contain the desired soil stabilization agent and is directed into the earth beneath the lower end of the panel. Preferably, this is carried out using the panel of the invention. The fluid flow is then directed to flow through the passage and optionally the nozzle and into the earth. It should be appreciated that the soil stabilization chemical can be added even after the panel is positioned, as it can be caused to flow through the annulus between the rebar and the wall of the passage. Usually, the soil stabilization chemical comprises a lime slurry, although other chemicals, such as cement, barytes, drilling fluids, and even sand may be used as well.

EXAMPLE OF A PREFERRED EMBODIMENT

Retaining walls installed for the control of soil erosion have been utilized in many applications including flood protection, ocean wave barriers, river bank barriers, and boat slips. The retaining walls help to keep water from damaging or destroying valuable property. But for the walls to be effective, they must be purposefully designed to withstand many years of constant environmental abuse. That is why the "Jet Pile Sheet Piling" has been invented. The "Jet Pile Sheet Piling" is installed as a series of interlocking barriers that forms a border against water penetration. The ability to resist intrusion by water is provided by a unique interconnecting standard that also allows the individual barriers to conform to irregular landscaping features.

The "Jet Pile Sheet Piling" consists of the barriers, an optional rebar, an anchoring system with tie back rods, a waler, stainless steel bolts, cap plugs, and a cap. The barriers are extruded from PVC granules, optional pigments and a chemical stabilizer to resist ultraviolet degradation. Another chemical additive is used to make the material more flame resistant. The barrier sheets are molded in an elongated S-shape, i.e., with a reinforced through-hole at the center. The through-holes are used during the installation process as a water jetting feature, and can also be used to accommodate the optional rebars. The rebars are steel rods that make the installed barrier more rigid. The central position of the holes reduces the number of tie back rods associated with other sheet piling systems. High pressure water jetting, impact hammers, and vibratory devices are equally suitable for the installation.

The ends of the barriers are alternately fashioned with the male and female portions of a spear joint. The spear joints are inherently locked together, but can be sealed in a separate operation to form a watertight connection. The spear joints are designed with sufficient flex to allow the sections to be installed around corners or curved walls. The rebar, when used, provides a secure anchoring system below the level of the bottom of the barrier. It is driven deep into the ground to make the structure stronger.

The stainless steel bolts secure the waler to the top front edge of the barriers, and also provide a means of fastening the tie back rods. The caps are shallow, U-shaped covers that are installed over the top edges of the barrier segments. They are secured with the cap plugs. The caps, cap plugs, and walers are fabricated from high density recycled plastic polymers to make best use of these resources.

The "Jet Pile Sheet Piling" delivers a strong pile wall that is lightweight, environmentally benign, and virtually maintenance free. It can be molded in many different colors to suit the needs of the application. The design even allows for the injection of soil stabilization chemicals. The materials used in its construction will not rust, corrode, nor sustain the growth of fungi. The "Jet Pile sheet Piling" provides a great level of protection against erosion, yet is relatively economical.

What is claimed is:

1. A bulkhead formed from a plurality of panels connected edge to edge, each panel having a first edge defined by a tenon, a second edge defined by a mortise sized to receive the tenon, a first end, a second end, a longitudinal axis extending between the first end and the second end, a first longitudinal bend between the longitudinal axis and the tenon, and a second longitudinal bend between the longitudinal axis and the mortise, said first longitudinal bend and said second longitudinal bend being corotationally directed with respect to the longitudinal axis of the panel, and a generally tubularly shaped section positioned between the tenon and the mortise and defining a throughbore from the first end to the second end of the panel, wherein a stake positioned in each throughbore to secure each panel to the earth.

2. A bulkhead comprising an undulating wall having generally vertically oriented bends, a first side surface, a second side surface, an upper end, and a lower end; and a longitudinally elongated cap having a top side and a bottom side with the bottom side forming a straight channel which receives the upper end of said undulating wall, said longitudinally elongated cap being positioned in capping relationship with said undulating wall along the upper end of the undulating wall, wherein the channel is defined by a first sidewall surface facing the first side surface of the undulating wall, a second sidewall surface facing the second side surface of the undulating wall, and an upper endwall facing the upper end of the undulating wall; and a longitudinally elongated stiffener having a longitudinal axis positioned alongside the longitudinally elongated cap between the first side surface of the undulating wall and the first sidewall surface of the channel, wherein the longitudinally elongated stiffener is tightly received between the first sidewall surface of the channel and portions of the first side surface of the undulating wall, and wherein the longitudinally elongated stiffener is rectangular in cross section across the longitudinal axis of the stiffener.

3. A bulkhead as in claim 2 wherein the undulating wall is formed by a plurality of pairs of panels, each said pair being formed by a first panel and a second panel, each of said first panel and said second panel having a first edge defined by a tenon, a second edge defined by a mortise sized to receive the tenon, a first end, a second end, a longitudinal axis extending between the first end and the second end, a first longitudinal bend between the longitudinal axis and the tenon, and a second longitudinal bend between the longitudinal axis and the mortise, said first longitudinal bend and said second longitudinal bend being corotationally directed with respect to the longitudinal axis of panel so that each panel is generally S-shaped in cross-section across the longitudinal axis and has a first curved portion and a second curved portion, wherein the tenon of the first panel is joined to the mortise of the second panel by a tenon in mortise joint and the first end of the first panel is positioned next to the second end of the second panel to form each pair of panels.

4. A bulkhead as in claim 3 wherein the mortise is contacted by the second sidewall surface of the channel.

5. A bulkhead as in claim 3 wherein a curved portion of each panel is contacted by the second sidewall surface of the channel.

6. A bulkhead comprising an undulating wall having generally vertically oriented bends, a first side surface, a second side surface, an upper end, and a lower end; and a longitudinally elongated cap having a top side and a bottom side with the bottom side forming a straight channel which receives the upper end of said undulating wall, said longitudinally elongated cap being positioned in capping relationship with said undulating wall along the upper end of the undulating wall, wherein the channel is defined by a first sidewall surface facing the first side surface of the undulating wall, a second sidewall surface facing the second side surface of the undulating wall, and an upper endwall facing the upper end of the undulating wall; and a longitudinally elongated stiffener having a longitudinal axis positioned alongside the longitudinally elongated cap between the first side surface of the undulating wall and the first sidewall surface of the channel, wherein the longitudinally elongated stiffener is tightly received between the first sidewall surface of the channel and portions of the first side surface of the undulating wall, and wherein the longitudinally elongated stiffener is rectangular in cross section across the longitudinal axis of the stiffener;

wherein the undulating wall is formed by a plurality of pairs of panels, each said pair being formed by a first panel and a second panel, each of said first panel and said second panel having a first edge defined by a tenon, a second edge defined by a mortise sized to receive the tenon, a first end, a second end, a longitudinal axis extending between the first end and the second end, a first longitudinal bend between the longitudinal axis and the tenon, and a second longitudinal bend between the longitudinal axis and the mortise, said first longitudinal bend and said second longitudinal bend being corotationally directed with respect to the longitudinal axis of the panel so that each panel is generally S-shaped in cross-section across the longitudinal axis and has a first curved portion and a second curved portion, wherein the tenon of the first panel is joined to the mortise of the second panel by a tenon in mortise joint and the first edge of the first panel is positioned next to the second edge of the second panel to form each pair of panels, wherein a curved portion of each panel is contacted by the second sidewall surface of the channel, and wherein each panel has a borehole positioned along the longitudinal axis of the panel, said bulkhead further comprising a stake positioned in each borehole securing each panel to the earth, and said first curved portion and said second curved portion are radiused so that the pair of panels are generally U-shaped in cross-section across the longitudinal axis of the panel.

7. A bulkhead as in claim 2 wherein each panel has a generally tubularly shaped section with a first end and a second end positioned along the longitudinal axis and defining a borehole, wherein the first end of the generally tubularly shaped section is positioned adjacent to the longitudinally elongated cap, said bulkhead further comprising an end closure positioned on the second end of the generally tubularly shaped section closing the borehole, said end closure having a generally cylindrically shaped portion closely received by the borehole and a conically shaped portion having a big end and a little end extending away from the borehole and coming to a point, wherein the big end of the conically shaped portion is positioned in covering relationship with the second end of the generally tubularly shaped section.

8. A bulkhead as in claim 2 wherein each panel has a generally tubularly shaped section with a first end and a second end positioned along the longitudinal axis and defining a borehole, wherein the first end of the generally tubularly shaped section is positioned adjacent to the longitudinally elongated cap, said bulkhead further comprising a pin extending through the longitudinally elongated cap and closely received by the first end of the borehole, said pin securing said longitudinally elongated cap to each panel.

* * * * *